US006689990B2

(12) United States Patent
Taniguchi et al.

(10) Patent No.: US 6,689,990 B2
(45) Date of Patent: Feb. 10, 2004

(54) GLOW PLUG WITH ELECTRIC CONDUCTOR CONNECTED TO METAL SLEEVE

(75) Inventors: Masato Taniguchi, Aichi (JP); Masaru Oshima, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/208,794

(22) Filed: Aug. 1, 2002

(65) Prior Publication Data

US 2003/0042242 A1 Mar. 6, 2003

(30) Foreign Application Priority Data

Aug. 28, 2001 (JP) ..... 2001-258074
Nov. 30, 2001 (JP) ..... 2001-367350

(51) Int. Cl.[7] ..... F23Q 7/00

(52) U.S. Cl. ..... 219/270; 219/541; 219/544; 123/145 A

(58) Field of Search ..... 219/270, 267, 219/544, 541; 123/145 A, 145 R

(56) References Cited

U.S. PATENT DOCUMENTS 4,556,780 A * 12/1985 Atsumi et al. ..... 219/270
4,563,568 A * 1/1986 Takizawa ..... 219/270
5,218,183 A * 6/1993 Kimata ..... 219/270
5,362,944 A * 11/1994 Hatanaka et al. ..... 219/270
5,883,360 A * 3/1999 Tatematsu et al. ..... 219/270
6,111,223 A * 8/2000 Tatematsu ..... 219/270

FOREIGN PATENT DOCUMENTS

JP 62-141423 6/1987
JP 4-268112 9/1992

* cited by examiner

*Primary Examiner*—John A. Jeffery
(74) *Attorney, Agent, or Firm*—Sughrue Mion, PLLC

(57) ABSTRACT

A glow plug comprises a ceramic heater having an insulating ceramic substrate, a heating resistor embedded in a front end portion of the ceramic substrate and a pair of first and second electric conductors embedded in the ceramic substrate and electrically connected at front end portions thereof to the heating resistor, a metallic sleeve circumferentially surrounding the ceramic heater with a front end portion of the ceramic heater protruded from the metallic sleeve, a metallic shell fitted onto the metallic sleeve, and a central electrode partly disposed in a rear portion of the metallic shell. The first and second electric conductors have rear end portions exposed at a rear end surface of the ceramic heater and electrically connected to the metallic shell and the central electrode via first and second connecting members, respectively.

19 Claims, 10 Drawing Sheets

GLOW PLUG WITH ELECTRIC CONDUCTOR CONNECTED TO METAL SLEEVE

BACKGROUND OF THE INVENTION

The present invention relates to a glow plug for use in a diesel engine.

Hereinafter, the term "front" refers to a heating end side with respect to the axial direction of a glow plug, and the term "rear" refers to a side opposite the front side.

A glow plug is widely used for the preheating of a diesel engine, which comprises a metallic sleeve, a rod-shaped ceramic heater disposed in the metallic sleeve with a front end portion thereof protruded from the metallic sleeve and a metallic shell fitted onto the metallic sleeve by e.g. brazing. The ceramic heater generally includes an insulating ceramic substrate, a heating resistor embedded in a front end portion of the ceramic substrate and a pair of electric conductors (such as high-melting lead wires made of e.g. conductive ceramic or tungsten) embedded in the ceramic substrate and electrically connected to the heating resistor. In order to supply power to the heating resistor through the electric conductors, the electric conductors are exposed to the outside of the ceramic heater. More specifically, one of the electric conductors is exposed at a rear end surface of the ceramic heater and connected to power source (such as a battery) via a terminal member, and the other of the electric conductors is exposed at an outer circumferential surface of the ceramic heater and joined to the metallic sleeve so as to establish a ground, as disclosed in Japanese Laid-Open Patent Publication No. 4-268112.

SUMMARY OF THE INVENTION

In the above-mentioned structure, however, it is difficult to establish a proper joint for electrical connection between the metallic sleeve and the grounding conductor by welding or brazing while securing a large joint surface therebetween. If the joint is improper, the ceramic heater cannot be energized to generate heat sufficiently. In addition, there arises a possibility of undesired heat generation at the joint.

It is therefore an object of the present invention to provide a glow plug in which a proper electrical connection can be easily and assuredly established between the metallic sleeve and the grounding conductor of the ceramic heater.

According to one aspect of the present invention, there is provided a glow plug comprising: a ceramic heater having an insulating ceramic substrate, a heating resistor embedded in a front end portion of the ceramic substrate, and a pair of first and second electric conductors embedded in the ceramic substrate and electrically connected at front end portions thereof to the heating resistor; and a metallic sleeve circumferentially surrounding the ceramic heater with a front end portion of the ceramic heater protruded from the metallic sleeve, the first electric conductor having a rear end portion exposed at a rear end surface of the ceramic heater and electrically connected to the metallic sleeve.

According to another aspect of the present invention, there is provided a glow plug comprising: a ceramic heater having an insulating ceramic substrate, a heating resistor embedded in a front end portion of the ceramic substrate, and a pair of first and second electric conductors embedded in the ceramic substrate and electrically connected at front end portions thereof to the heating resistor; a metallic sleeve circumferentially surrounding the ceramic heater with a front end portion of the ceramic heater protruded from the metallic sleeve; a metallic shell fitted onto the metallic sleeve; and a central electrode disposed in a rear portion of the metallic shell, the first and second electric conductors having rear end portions exposed at a rear end surface of the ceramic heater and electrically connected to the metallic sleeve and the central electrode, respectively.

DESCRIPTION OF THE EMBODIMENTS

Figure 1:
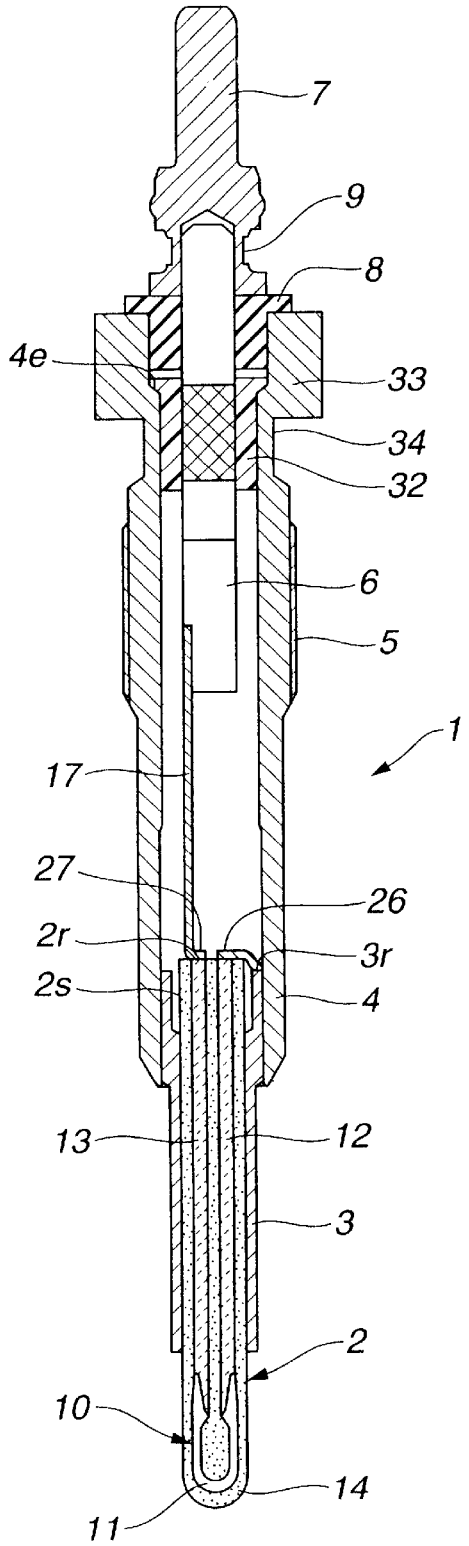
FIG. 1 is a sectional view of a glow plug according to a first embodiment of the present invention.

Hereinafter, an explanation will be given of a glow plug according the present invention by way of preferred embodiments. Like parts and portions in the following embodiments are designated by like reference numerals, and repeated descriptions thereof are omitted.

First, a glow plug 1 according to a first embodiment of the present invention will be described with reference to FIGS. 1 to 7.

Figure 2:
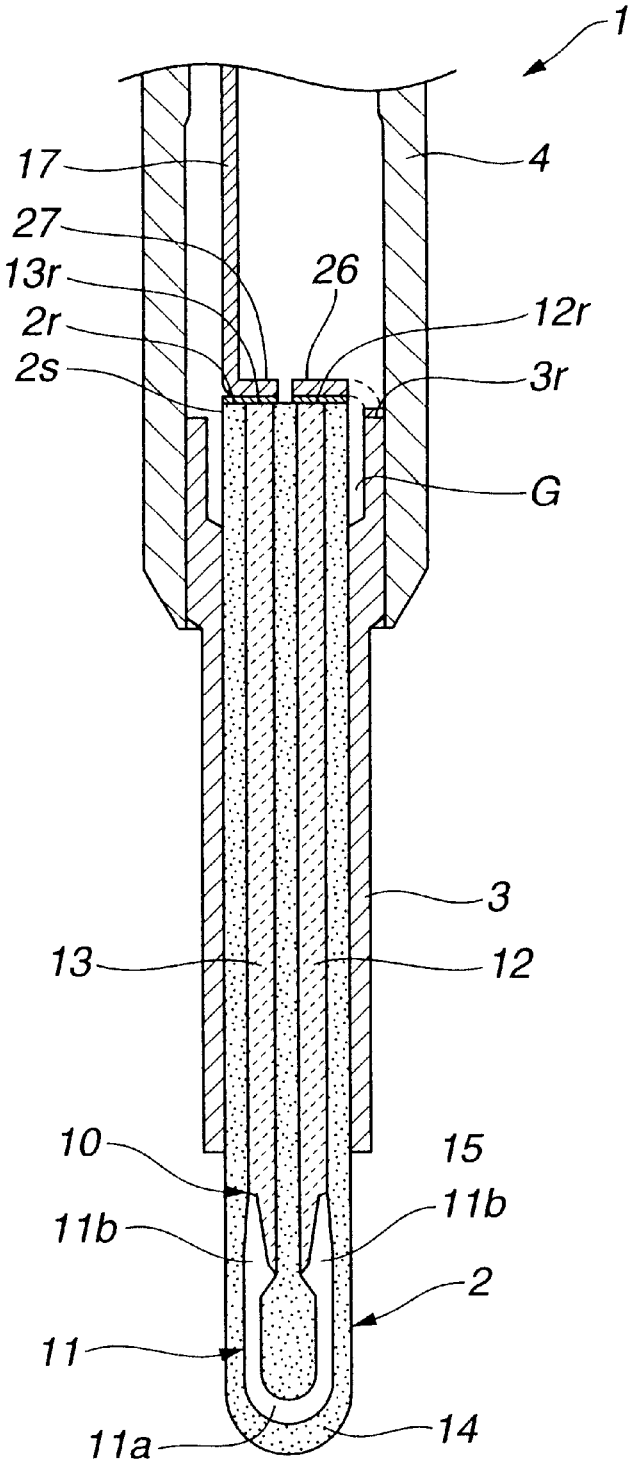
FIG. 2 is a sectional view of a front portion of the glow plug of FIG. 1.

Referring to FIGS. 1 and 2, the glow plug 1 comprises a rod-shaped ceramic heater 2, a metallic sleeve 3 circumferentially surrounding the ceramic heater 2 with a front end portion of the ceramic heater 2 protruded from the metallic sleeve 3, a cylindrical metallic shell 4 retaining therein a rear end portion of the metallic sleeve 3, a metallic central electrode 6 partly disposed in a rear portion of the metallic shell 4 for power supply to the ceramic heater 2, and a lead wire 17 through which the ceramic heater 2 and the central electrode 6 are electrically connected to each other. A threaded portion 5 is formed on an outer circumferential surface of the metallic shell 4 so as to mount the glow plug 1 in a cylinder head (not shown).

The metallic shell 4 is fitted onto the metallic shell 3 by brazing (i.e., filling a space between an inner circumferential surface of the metallic shell 4 and an outer circumferential surface of the metallic sleeve 3 with a brazing filler) or by laser welding an inner front edge of the metallic shell 4 to the outer circumferential surface of the metallic sleeve 3. The metallic sleeve 3 is fixed to the ceramic heater 2 by brazing or a close fit.

Figure 3:
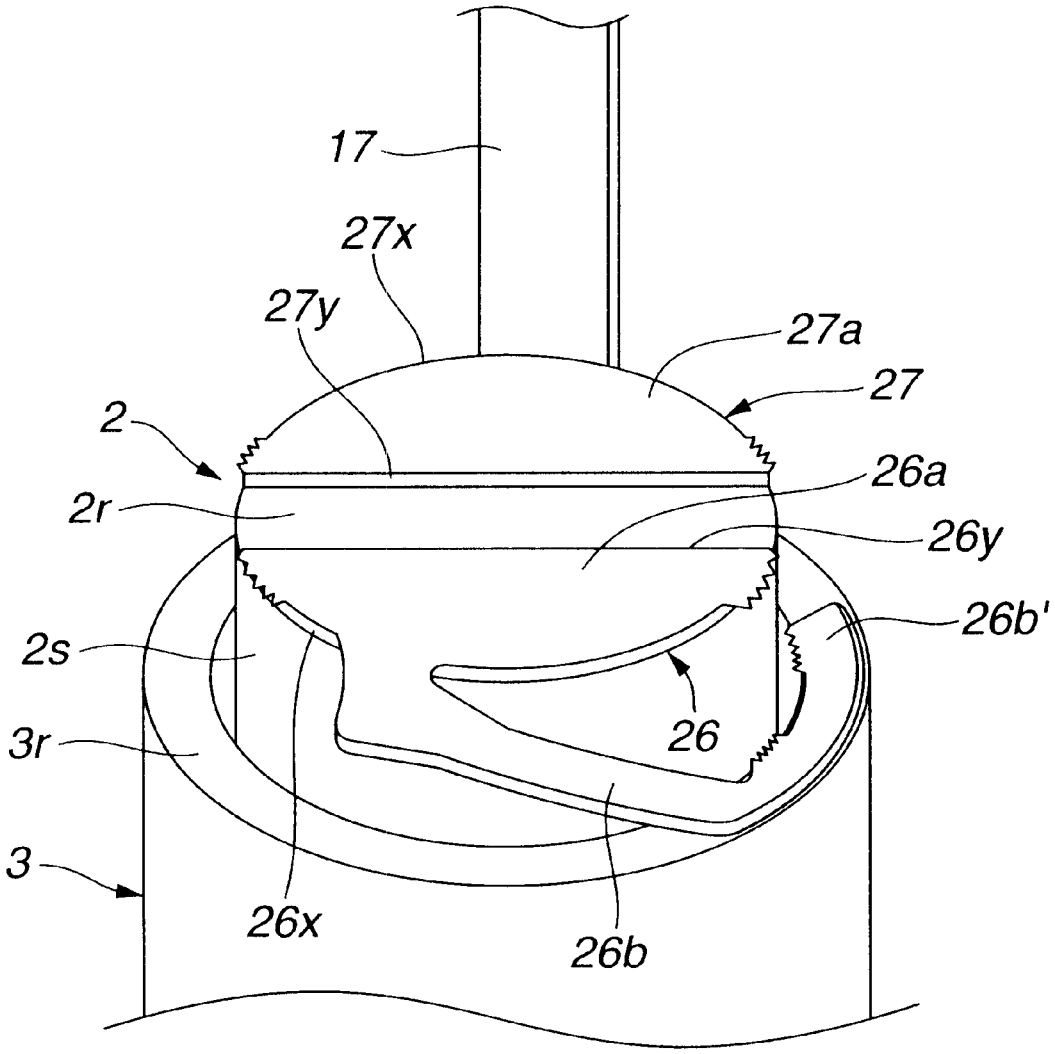
FIG. 3 is a perspective view of a rear end portion of a ceramic heater according to the first embodiment of the present invention, in a state of being connected to a metallic sleeve and a lead wire through first and second connecting members, respectively.

Referring to FIGS. 2 and 3, the ceramic heater 2 is disposed in the metallic sleeve 3 so that a rear end portion of the ceramic heater 2 is protruded from the metallic sleeve 3. Further, the inside diameter of the rear end portion of the metallic sleeve 3 is made larger so as to provide a clearance G between an inner circumferential surface of the rear end portion of the metallic sleeve 3 and an outer circumferential surface 2*s* of the ceramic heater 2.

The ceramic heater 2 has a ceramic substrate 14 and a heating unit 10. The heating unit 10 includes a U-shaped heating resistor 11 embedded in a front end portion of the ceramic substrate 14 and a pair of rod-shaped electric conductors 12 and 13 embedded in the ceramic substrate 14 on the rear side of the heating resistor 11. The heating resistor 11 has a front end portion 11*a* (i.e. the bottom of U-shape) and rear end portions 11*b* formed with joint faces 15. The front end portion 11*a* is made smaller in diameter than the rear end portions 11*b* so that supply current becomes concentrated at the front end portion 11*a*, thereby heating the front end portion 11*a* to the highest temperature in a state of working. The electric conductors 12 and 13 are generally in parallel along an axis of the glow plug 1, and have front end portions connected to the joint faces 15 of the heating resistor 11 and rear end portions 12*r* and 13*r* exposed at a rear end surface 2*r* of the ceramic heater 2, respectively. The exposed rear end portion 12*r* of the conductor 12 is electrically connected to the metallic sleeve 3, while the exposed rear end portion 13*r* of the conductor 13 is electrically connected to the lead wire 17.

The glow plug 1 further comprises a first connecting member 26 through which the exposed rear end portion 12*r* of the conductor 12 is electrically connected to a rear end face 3*r* of the metallic sleeve 3. The glow plug 1 also comprises a second connecting member 27 through which the exposed rear end portion 13*r* of the conductor 13 is electrically connected to a front end portion of the lead wire 17, although the rear end portion 13*r* of the conductor 13 may be directly connected to the lead wire 17. The first and second connecting members 26 and 27 are provided so as not to have a direct electrical connection therebetween.

More specifically, the first and second connecting members 26 and 27 are joined to parts of the rear end surface 2*r* of the ceramic heater 2 via brazing layers 36 and 37 so as to cover the exposed rear end portions 12*r* and 13*r* of the electric conductors 12 and 13, respectively, but not to cover the outer circumferential surface 2*s* of the ceramic heater 2. That is, there is no need to provide extra radial space for the first and second connecting members 26 and 27, whereby the glow plug 1 can be made compact in size especially when making the diameter of the ceramic heater 2 smaller. Further, the ceramic heater 2 can be therefore effectively prevented from becoming cracked without the outer circumferential surface 2*s* of the ceramic heater 2 being intensely acted upon by a large thermal stress, even when the glow plug 1 is heated and cooled in cycles. In addition, it is possible to reduce the risk of a short circuit by excluding the first and second connecting members 26 and 27 from the clearance G.

Each of the first and second connecting members 26 and 27 is formed into a plate. Thus, the first connecting member 26 has a front surface 26*q* connected via the brazing layer 36 with the part of the rear end surface 2*r* of the ceramic heater 2 including an exposed surface of the rear end portion 12*r* of the electric conductor 12, while the second connecting member 27 has a front surface 27*q* connected via the brazing layer 37 with the part of the rear end surface 2*r* of the ceramic heater 2 including an exposed surface of the rear end portion 13*r* of the electric conductor 13. This makes it possible to secure larger joint surfaces between the ceramic heater 2 and each of the first and second connecting members 26 and 27, between the electric conductor 12 and the first connecting member 26 and between the electric conductor 13 and the second connecting member 27 and thereby possible to increase joint strengths therebetween. Further, the first and second connecting members 26 and 27 can be easily joined to the rear end surface 2*r* of the ceramic heater 2 by brazing in such a structure, and much expense in time and effort is not needed to provide the first and second connecting members 26 and 27.

In the first embodiment, the first connecting member 26 has a first conductive portion 26*a* joined to the rear end surface 2*r* of the ceramic heater 2 via the brazing layer 36 and a second conductive portion 26*b* joined at an end 26*b*' thereof to the rear end face 3*r* of the metallic sleeve 3, as shown in FIG. 3. The second conductive portion 26*b* is formed integrally with the first conductive portion 26*a* so as to extend to the rear end face 3*r* of the metallic sleeve 3 along an arc (such as a spiral with its center coincident with the axis of the glow plug 1). The end 26*b*' of the second conductive portion 26*b* is shaped to fit with the rear end face 3*r* of the metallic sleeve 3. This makes it possible to secure a larger joint surface between the metallic sleeve 3 and the first connecting member 26 and thereby possible to increase a joint strength therebetween.

The end 26*b*' of the second conductive portion 26 can be joined to the rear end face 3*r* of the metallic sleeve 3 by welding or brazing. For the metal-metal joint between the first connecting member 26 and the metallic sleeve 3, preferred is welding, such as resistance welding, laser welding, electron beam welding and the like. In the presence of the clearance G, the first connecting member 26 can be easily joined to the metallic sleeve 3. The clearance G is preferably more than or equal to 0.1 mm so that the first connecting member 26 can be easily joined to the metallic sleeve 3 and, at the same time, less than or equal to 1.0 mm so as to make the glow plug 1 compact in size. In the first embodiment, the clearance G is 0.5 mm.

The second connecting member 27 also has a conductive portion 27*a* joined to the rear end surface 2*r* of the ceramic heater 2 via the brazing layer 37, as shown in FIG. 3.

The conductive portions 26*a* and 27*a* of the first and second connecting members 26 and 27 are generally semi-circular, being defined by circular edges 26*x* and 27*x* and linear edges 26*y* and 27*y*, respectively. The first and second connecting members 26 and 27 are disposed oppositely to each other so as to provide a predetermined spacing between the linear edges 26*y* and 27*y*. In order to establish a proper insulation between the first and second connecting members 26 and 27, the spacing is preferably more than or equal to 0.1 mm. The spacing is preferably less than or equal to 1.0 mm in terms of the miniaturization of the glow plug 1.

Further, the lead wire 17 and the second connecting member 27 are formed into one piece in the first embodiment, so that the lead wire 17 extends axially from the circular edge 27*x* of the second connecting member 27 in the first embodiment. Then, the lead wire 17 is joined to a front end portion of the central electrode 6 by e.g. resistance welding, as shown in FIG. 1.

Figure 4:
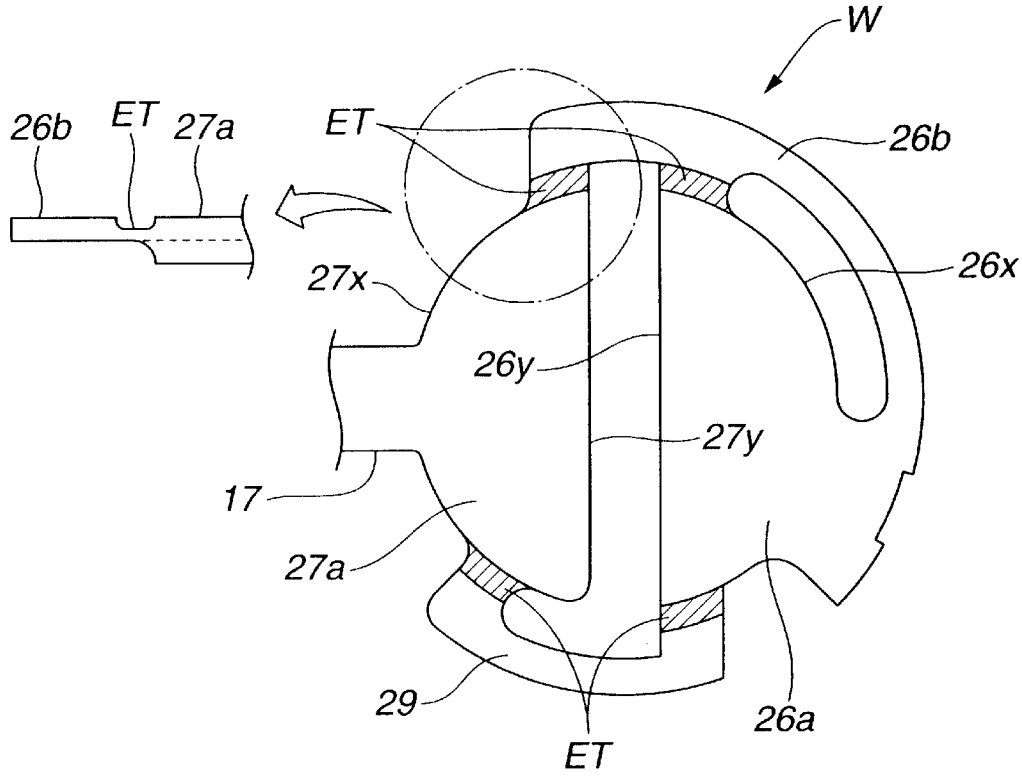
FIG. 4 is a plan view of the first and second connecting members of FIG. 3, before joined to the ceramic heater and the metallic sleeve.

Referring to FIG. 4, the first and second connecting members 26 and 27 may be held together as a single plate W by means of thin portions ET (i.e. the diagonally shaded portions of FIG. 4) and a retaining portion 29, before joined to the rear end surface 2*r* of the ceramic heater 2. The plate W is formed by e.g. punching so that, when the plate W is placed on the rear end surface 2*r* of the ceramic heater 2, the second conductive portion 26*b*, the thin portions ET and the retaining portion 29 are protruded from the rear end surface 2*r* of the ceramic heater 2. In the plate W, both the second conductive portion 26*b* and the retaining portion 29 perform the function of keeping the shape of the plate W by connecting the conductive portions 26*a* and 27*a* via the thin portions ET. The thin portions ET are made smaller in thickness than the first and second connecting members 26 and 27 by e.g. grinding, so that the thin portions ET can be easily broken after the first and second connecting members 26 and 27 are joined to the ceramic heater 2. Then, the broken thin portions ET are removed together with the retaining portion 29.

In the case of using such a plate W, the first and second connecting members 26 and 27 are joined to the ceramic heater 2 and the metallic sleeve 3 by the following procedure.

Figure 5:
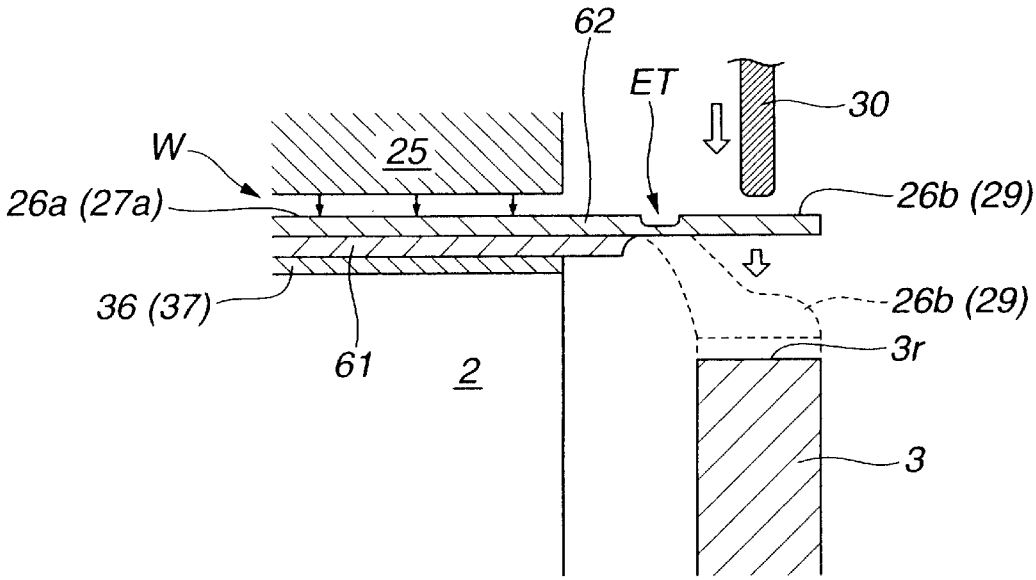
FIG. 5 is an illustration showing how to join the first and second connecting members of FIG. 4 to the ceramic heater and to the metallic sleeve.

Referring now to FIG. 5, the conductive portions 26*a* and 27*a* of the connecting members 26 and 27 of the plate W are firstly joined to the rear end surface 2*r* of the ceramic heater 2 via the brazing layers 36 and 37, respectively, to make electrical connections between the first connecting member 26 and the electric conductor 12 and between the second connecting member 27 and the electric conductor 13. Herein, there is a need for proper positioning of the first and second connecting members 26 and 27 relative to the rear end surface 2*r* of the ceramic heater 2 for good electrical connection, and the proper positioning of the first and second connecting members 26 and 27 becomes more pronounced as the diameter of the ceramic heater 2 decreases. In the first embodiment, the first and second connecting members 26 and 27 are held together as a single plate W at the time of being placed on and brazed to the rear end surface 2*r* of the ceramic heater 2. Also, the retaining portion 29 serves as a guide for positioning the connecting members 26 and 27. It is therefore possible to position the first and second connecting members 26 and 27 more accurately than to position separate connecting members and possible to reduce the risk of a short circuit upon contact between the first and second connecting members 26 and 27.

Then, the outer edge of the plate W, i.e., the second conductive portion 26*b* and the retaining portion 29 are pressed by mechanical means (e.g. a punch 30), and the thin portions ET are caused to become broken. At this time, the plate W may be supported from the rear side by means of a jig 25. It is easier in the first embodiment to press the second conductive portion 26*b* and the retaining portion 29 because the rear end surface 2*r* of the ceramic heater 2 is protruded from the metallic sleeve 3. The thin portions ET are removed together with the retaining portion 29. The plate W is folded at a boundary of the lead wire 17 and the second connecting member 27 so that the lead wire 17 extends axially of the glow plug 1 toward the rear, and then joined to the front end portion of the central electrode 6.

The end 26*b*' of the second conductive portion 26*b* is joined to the rear end face 3*r* of the metallic sleeve 3. Although any of the above-mentioned joining methods can be applied, resistance welding is preferred for that its welding process is simple and that it is easier to secure a larger joint surface between the first connecting member 26 and the metallic sleeve 3 and thus increase a joint strength therebetween. Projection welding is especially preferred in order to increase the joint strength between the first connecting member 26 and the metallic sleeve 3. In the case of projection welding, the plate W needs to be formed by punching with a protrusion at the end 26' of the second conductive portion 26.

Figure 7:
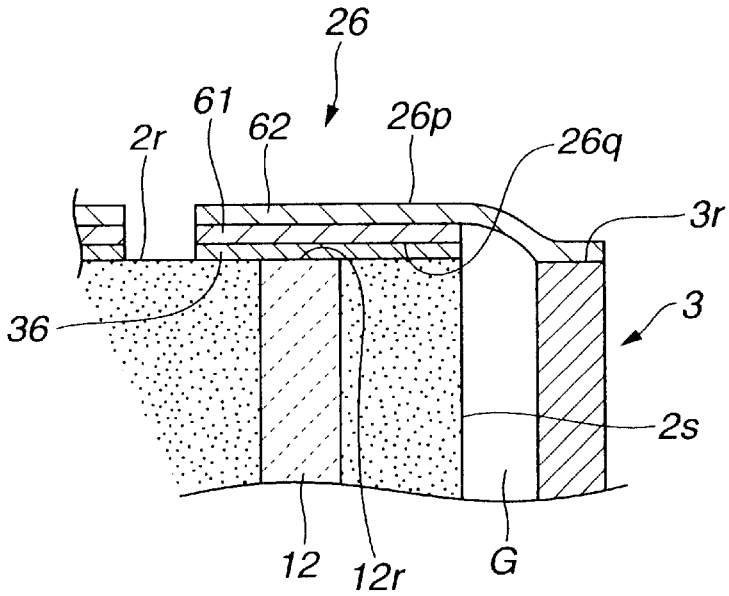
FIG. 7 is a sectional view illustrating a joint between a ceramic heater and a metallic sleeve via a first connecting member according to a modification of the first embodiment.

In a modification of the first embodiment, the rear end surface 2*r* of the ceramic heater 2 may be axially at the same position to the rear end face 3*r* of the metallic sleeve 3, as shown in FIG. 7. In such a case, the thin portions ET can be removed by laser processing. Alternatively, the first and second connecting members 26 and 27 may be formed into separate pieces and joined individually to the rear end surface 2*r* of the ceramic heater 2.

In the ceramic heater 2, the ceramic substrate 14 is made of ceramic having an insulation property, and the heating resistor 11 and the electric conductors 12 and 13 are made of ceramic having electrical conductivity. As the entire ceramic heater 2 is made of ceramic, it can be produced without much expenses in time and effort.

The ceramic for the ceramic substrate 14 can be any insulating ceramic material. In the first embodiment, silicon nitride ceramic is used. The silicon nitride ceramic generally contains grains mainly made of silicon nitride ($Si_3N_4$) bonded to each other through grain boundary resulting from a sintering aid. The silicon nitride may contain Al and O with which some of Si and N are substituted, respectively. The grains may contain a metal atom or atoms, such as Li, Ca, Mg and/or Y, in the silicon nitride as a solid solution. The sintering aid includes a cationic element or elements selected from Groups 3A, 4A, 5A, 3B (e.g. Al) and 4B (e.g. Si) of the Periodic Table and Mg. The above cationic element and elements are added in the form of oxide, and contained in the form of oxide or compound oxide (such as silicate) in the sintered silicon nitride ceramic. The amount of the sintering aid is from 1 to 10% by weight in terms of oxide based on the total weight of the sintered silicon nitride ceramic. When the amount of the sintering aid is less than 1% by weight, the ceramic material cannot be close-grained when sintered. On the other hand, when the amount of the sintering aid is more than 10% by weight, the obtained ceramic material does not attain a sufficient strength, toughness and/or heat resistance. Preferably, the amount of the sintering aid is from 2 to 8% by weight. In the case where the sintering aid includes rare-earth element or elements, there may be selected from Sc, Y, La, Ce, Pr, Nd, Sm, Eu, Gd, Tb, Dy, Ho, Er, Tm, Yb and Lu. Among these elements, preferred are Tb, Dy, Ho, Er, Tm and Yb because they provide effects of promoting the crystallization of the grain boundary and improving a high-temperature strength of the grain boundary.

The ceramic for the heating resistor 11 (hereinafter referred to as "first ceramic") has a higher electrical resistance than the ceramic for the conductors 12 and 13 (referred to as "second ceramic"). The method for providing the first and second ceramic with different electrical resistances is not particularly restricted. For example, there may be used:

(1) the method in which the same kind of conductive ceramic material is contained in the first and second ceramic with different contents thereof;

(2) the method in which different kinds of conductive ceramic materials having distinct electrical resistances are contained in the first and second ceramic, respectively; or (3) the method in which the same and different kinds of conductive ceramic materials are contained in the first and second ceramic in combination.

In the first embodiment, the method (1) is used. The conductive ceramic material can be e.g. tungsten carbide (WC), siliconized molybdenum ($MoSi_2$) and siliconized tungsten ($WSi_2$). In the first embodiment, tungsten carbide is used.

In order to reduce differences in coefficients of linear expansion between the heating resistor 11 and the ceramic substrate 14 and between the electric conductors 12 and 13 and the ceramic substrate 14 and thereby increase heat and impact resistance, the same insulating ceramic material as used for the ceramic substrate 14 (in the first embodiment, silicon nitride ceramic) are added to the first and second ceramic.

The electrical resistances of the first and second ceramic can be adjusted depending on the contents of the insulating ceramic material and of the conductive ceramic material. More specifically, the first ceramic for the heating resistor 11 comprises 10 to 25% by volume of the conductive ceramic material and the balance being the insulating ceramic material. When the amount of the conductive ceramic material is more than 25% by volume, the conductivity of the first ceramic becomes too high so that the heating resistor 11 cannot generate sufficient heat. When the amount of the conductive ceramic material is less than 10% by volume, the conductivity of the first ceramic becomes too low so that the heating resistor 11 cannot generate sufficient heat either. Further, the second ceramic for the conductors 12 and 13 comprises 15 to 30% by volume of the conductive ceramic material and the balance being the insulating ceramic material. When the amount of the conductive ceramic material is more than 30% by volume, the second ceramic cannot be close-grained when sintered and does not have a sufficient strength. In addition, the electrical resistance of the second ceramic does not rise sufficiently even when heated to a normal working temperature for the preheating of an engine, thereby failing to perform a self-control function to stabilize its current density. When the amount of the conductive ceramic material is less than 15% by volume, the conductors 12 and 13 generate heat, thereby deteriorating the heat-generating efficiency of the heating resistor 11. In the first embodiment, for example, the first ceramic comprises 16% by volume (55% by weight) of tungsten carbide and the balance being silicon nitride ceramic with the sintering aid, and the second ceramic comprises 20% by volume (70% by weight) of tungsten carbide and the balance being silicon nitride ceramic with the sintering aid.

The conductive portions 26*a* and 27*a* of the first and second connecting members 26 and 27 are joined to the rear end surface 2*r* of the ceramic heater 2 via the brazing layers 36 and 37, respectively, as described above. Such brazing layers 36 and 37 can be formed by brazing with an activated brazing material containing therein an active metal component or by metallizing the ceramic heater 2 by evaporation of an active metal component and then brazing with an ordinary brazing material. The brazing material can be any conventional Ag- or Cu-based brazing material, and the active metal component may include at least one of Ti, Zr and Hf. For example, a Cu-based activated brazing material comprising 5% by weight of Si, 3% by weight of Pd, 2% by weight of Ti and the balance being Cu may be used for the brazing layers 36 and 37. The brazing layers 36 and 37 are preferably formed by screen printing, so that the brazing layers 36 and 37 can be at proper positions on the rear end surface 2*r* of the ceramic heater 2 while being prevented from hanging over the outer circumferential surface 2*s* of the ceramic heater 2.

Figure 6:
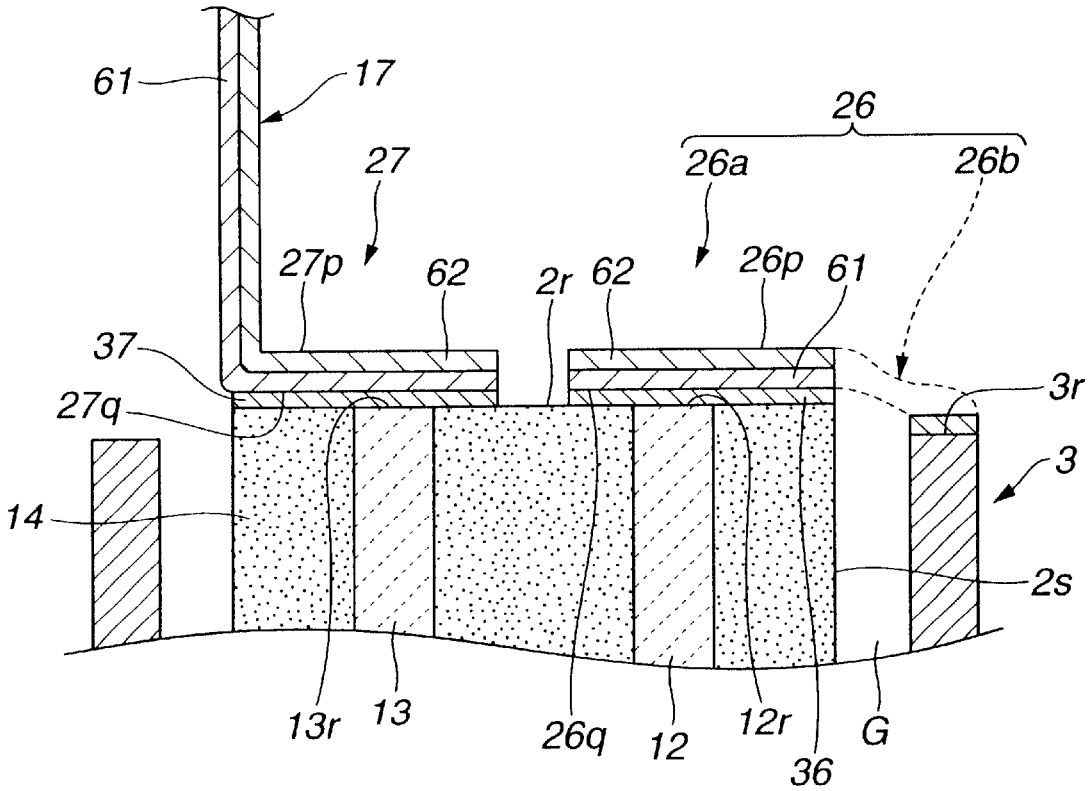
FIG. 6 is a sectional view illustrating the joint between the ceramic heater and the metallic sleeve via the first connecting member according to the first embodiment of the present invention.

In the ceramic-metal joint, there is a great difference in coefficients of linear expansion between the ceramic heater 2 and the brazing layers 36 and 37. As a result, the joint interface between the ceramic heater 2 and the brazing layers 36 and 37 is liable to be acted upon by a large thermal stress especially when the joint is cooled after formed by brazing and when the joint is heated and cooled in cycles through the use of the glow plug 1. In order to absorb such a thermal stress and increase durability of the ceramic-metal joint, the first and second connecting members 26 and 27 may have low-expansion metal layers 62 formed in rear surfaces 26*p* and 27*p* of the conductive portions 26*a* and 27*a* of the connecting members 26 and 27 so as to radially correspond in position to the brazing layers 36 and 37, respectively, while the front surfaces 26*q* and 27*q* of the conductive portions 26*a* and 27*a* are held in contact with the brazing layers 36 and 37, as shown in FIGS. 6 and 7. For convenience of production, the second connecting member 27 and the lead wire 17 are formed into one piece of a clad material having the low-expansion metal layer 62 in the first embodiment.

The low-expansion metal layers 62 are made of a metal having a lower coefficient of linear expansion than that of the brazing material for the brazing layers 36 and 37, so as to provide the effects of limiting substantial expansion and contraction of the brazing layers 36 and 37 and absorbing the thermal stress exerted on the ceramic-metal joint between the ceramic heater 2 and the brazing layers 36 and 37. This makes it possible to increase the durability of the ceramic-metal joint. More specifically, the low-expansion metal layers 62 can be made of a Fe-based low-expansion metal having an average coefficient of linear expansion lower than or equal to $2.0\times10^{-6}$/° C. within a temperature range from 100 to 200° C. Specific examples of such a low-expansion metal include Fe alloys (with a Fe content of 40% by weight or more) having very small coefficients of linear expansion under so-called Invar effect. Invar effect is a phenomenon in which, when ferromagnetism (including antiferromagnetism) occurs at room temperature to cause the expansion of a material, such expansion cancels out volume change resulting from lattice vibration so that the coefficient of linear expansion of the material is made small. The Fe alloy remarkably exhibits such an effect when containing specific contents of Ni, Co, Pd and/or Pt as alloy elements. Preferably, at least one of Ni and Co is contained in view of cost reduction. There may be added another element (e.g. Cr, Si or C) in order to improve mechanical properties, such as corrosion resistance, strength and workability as long as the alloy attains a required coefficient of linear expansion. The alloy may not exhibit a low coefficient of linear expansion when the first and second connecting members 26 and 27 are at the highest temperature (e.g. 700 to 900° C.) in a state of working, but always has a very small coefficient of linear expansion at a temperature lower than or equal to a magnetic transformation point thereof. When the alloy exhibits thermal hysteresis, displacements of the low-expansion metal layer 62 between its expansion state and contract state can be made smaller. Thus, the use of such an alloy is effective in preventing the cracking and separation of the ceramic-metal joint especially when the joint is cooled after formed by brazing. In order to attain such an effect, an alloy having a higher magnetic transformation point (e.g. 60° C. or higher) is preferably used. As the above-mentioned Fe-based alloy, there are exemplified by:

Invar (containing 36.5 wt % Ni with the balance of Fe, $\alpha=1.2\times10^{-6}$/° C., Tc=232° C.);

Super Invar (containing 32 wt % Ni and 5 wt % Co with the balance of Fe, $\alpha=0.1\times10^{-6}$/° C., Tc=229° C.; Kovar (alloy containing 29 wt % Ni and 17 wt % Co with the balance of Fe);

Stainless Invar (containing 54 wt % Co and 9.5 wt % Cr with the balance of Fe, $\alpha=0.1\times10^{-6}$/° C., Tc=117° C.);

Nobinite (as a trade name for cast iron, containing 32 wt % Ni, 5 wt % Co, 2.4 wt % C and 2 wt % Si with the balance of Fe, $\alpha=1.8\times10^{-6}$/° C., Tc=300° C.); and Low-expansion alloy (abbreviated as LEX alloy, containing 36 wt % Ni, 0.8 wt % C and 0.6 wt % Si with the balance of Fe, $\alpha=1.9\times10^{-6}$/° C., Tc=250° C.), where $\alpha$ is an average coefficient of linear expansion in a temperature range from 100 to 200° C., and Tc is a Curie point (i.e. a magnetic transformation point).

Further, the first and second connecting members 26 and 27 may additionally have soft metal layers 61 formed in the front surfaces 26*q* and 27*q* of the conductive portions 26*a* and 27*a* so as to be kept in contact with the brazing layers 36 and 37, as shown in FIGS. 6 and 7. In the first embodiment, the soft metal layers 61 and the low-expansion metal layers 62 are clad with each other so as to take on a two-layered clad structure in at least the conductive portions 26*a* and 27*a* of the first and second connecting members 26 and 27.

The soft metal layers 61 are made of a metal softer than the metal for the low-expansion metal layers 62, such as Cu or Cu alloy. The soft metal layers 61 get plastically deformed, when the brazing layers 36 and 37 are to be displaced relative to the ceramic heater 2 due to the difference in coefficients of linear expansion therebetween. This makes it possible to absorb the thermal stress exerted on the ceramic-metal joint and prevent the separation of the brazing layers 36 and 37 from the ceramic heater 2.

The soft metal (such as Cu or Cu alloy) for the soft metal layers 61 may not have good weldability to carbon steel and Ni alloy, though the metallic sleeve 3 is generally made of carbon steel or Ni alloy. For this reason, in the case of joining the second conductive portion 26*b* of the first connecting member 26 to the rear end face 3*r* of the metallic sleeve 3 by resistance welding (such as projection welding or spot welding), the soft metal layer 61 is not preferably provided in the second conductive portion 26*b*, as shown in FIG. 6, so that the first connecting member 26 can be welded to the metallic sleeve 3 at an increased strength. Unwanted part of the soft metal layer 61 can be removed by grinding or etching.

Referring again to FIG. 1, the central electrode 6 is disposed in the metallic shell 4 with an insulating bushing 8 being interposed between the metallic shell 4 and the rear end portion of the central electrode 6, whereby an electrical insulation between the metallic shell 4 and the central electrode 6 can be maintained. Further, a sealing member 32 made of an insulating polymer is provided in a space between the metallic shell 4 and the central electrode 6, and retained by a stepped portion 4*e* of the metallic shell 4 so that the sealing member 32 does not slip off from the front side. The metallic shell 4 is caulked to the terminal 6 via the sealing member 32 so as to form a caulked portion 34 at an axial position between the threaded portion 5 and a tool engaging portion 33, thereby ensuring air-tightness and allowing the metallic shell 4 to retain the central electrode 6 assuredly. An outer circumferential portion of the central electrode 6 (the shaded portion of FIG. 1) which contacts with the sealing member 32 is roughened by e.g. knurl processing. Further, a rear end portion of the central electrode 6 is protruded from the metallic shell 4, and a metallic terminal member 7 is fit onto the protruded end portion of the central electrode 6 and connected to a battery (not shown). The terminal member 7 is fixed to the central electrode 6 by caulking at a caulked portion 9 so as to establish an electrical connection between the central electrode 6 and the terminal member 7.

In the application of the above-described glow plug 1 to a diesel engine, the glow plug 1 is mounted in the cylinder head of the engine by means of the threaded portion 5 so that the front end portion of the ceramic heater 2 is positioned in e.g. a swirl chamber (which is connected to a combustion chamber of the engine). When electric current is passed through the central electrode 6, the lead wire 17, the second connecting member 27 and the ceramic heater 2, the first and second conductive portions 26*a* and 26*b* of the first connecting member 26, the metallic sleeve 3, the metallic shell 4 and the cylinder block (and then to a ground), the heating resister 11 of the ceramic heater 2 generates heat for warming up the swirl chamber.

Next, glow plugs according to second and third embodiments of the present invention will be described with reference to FIGS. 8A, 8B, 9 and 10. The second and third embodiments are similar to the first embodiment, except for the structure and material of the first connecting member 26.

Figure 8A:
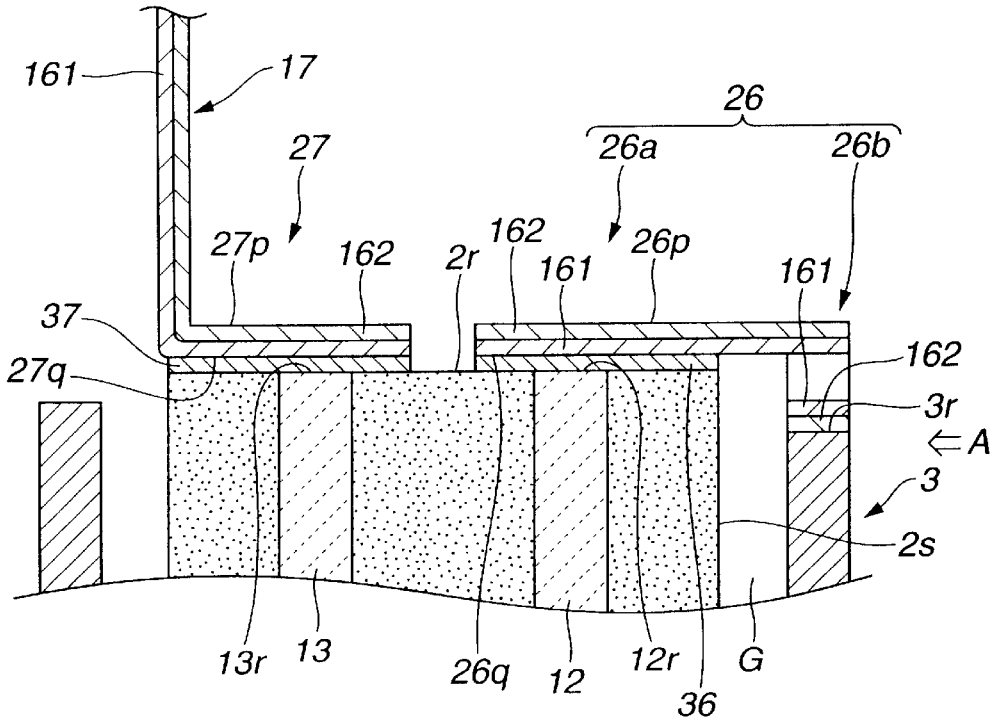
FIG. 8A is a sectional view illustrating a joint between a ceramic heater and a metallic sleeve via a first connecting member according to a second embodiment of the present invention.
Figure 8B:
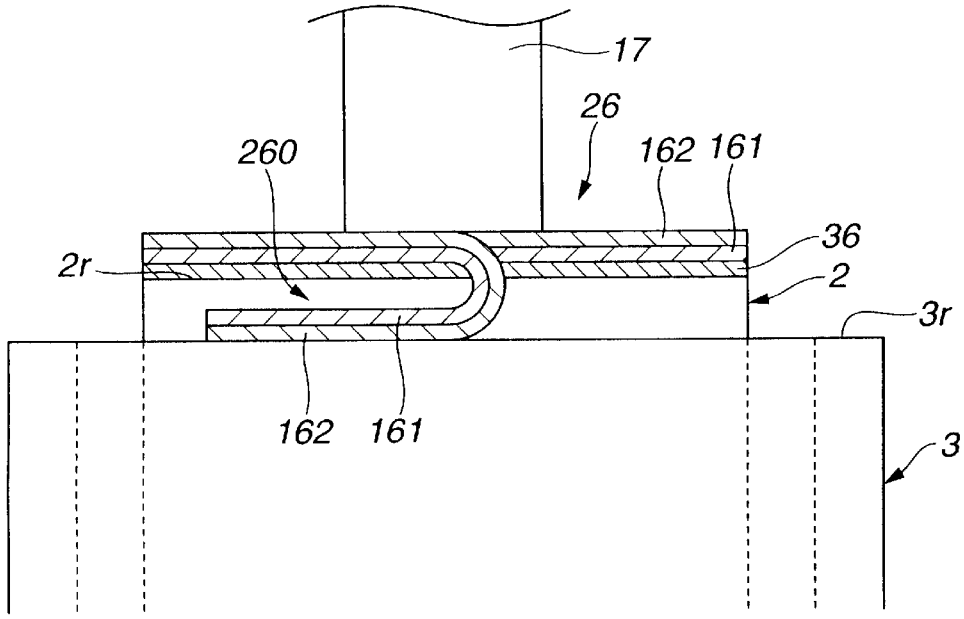
FIG. 8B is a side view of the first connecting member when viewed in the direction of an arrow A of FIG. 8A.

In the second embodiment, the first connecting member 26 is formed of a clad material having a first layer 161 and a second layer 162, as shown in FIGS. 8A and 8B. The first and second layers 161 and 162 are layered in a thickness direction thereof throughout the first connecting member 26. A material for the second layer 162 has a lower coefficient of linear expansion than a material for the first layer 161. The first layer 161 of the first conductive portion 26*a* is joined to the rear end surface 2*r* of the ceramic heater 2 via the brazing layer 36, and the second conductive portion 26*b* is folded over whereby the second layer 62 of the second conductive portion 26*b* is joined to the rear end face 3*r* of the metallic sleeve 3. As the second conductive portion 26*b* is located outside of the rear end surface 2*r* of the ceramic heater 2, the second conductive portion 26*b* is simply turned 180 degrees so that a turned-back end 260 of the second conductive portion 26*b* is joined by resistance welding the low-expansion metal layer 62 to the rear end face 3*r* of the metallic sleeve 3. The second conductive portion 26*b* is less prone to cracking and splitting when turned in a moderate curve. In order to turn the conductive portion 26*b* in a moderate curve, it is necessary to adjust the levels of the rear end surface 2*r* of the ceramic heater 2 and of the rear end face 3*r* of the metallic sleeve 3 properly. The second conductive portion 26*b* is preferably turned back so that at least part of the turned-back end 260 does not get under the rest of the second conductive portion 26*b* for ease of welding. The second connecting member 27 may also have a clad structure comprised of the first and second layers 161 and 162.

In the above-mentioned two-layered clad structure of the second embodiment, it is possible to provide the same effects of absorbing a thermal stress exerted on the ceramic-metal joint due to the difference in coefficients of linear expansion between the ceramic heater 2 and the brazing layers 35 and 36 and of increasing joint strengths between the first connecting member 26 and the ceramic heater 2 and between the first connecting member 26 and the metallic sleeve 3, as in the structure of the first embodiment. Further, there is no fear of increasing contact resistance of the first connecting member 26 because the whole of the first connecting member 26 can made of a single clad material to have a relatively small thickness. The metals of the soft metal layer 61 and the low-expansion metal layer 62 of the first embodiment can be used as the materials for the first and second layers 161 and 162, respectively.

Figure 9:
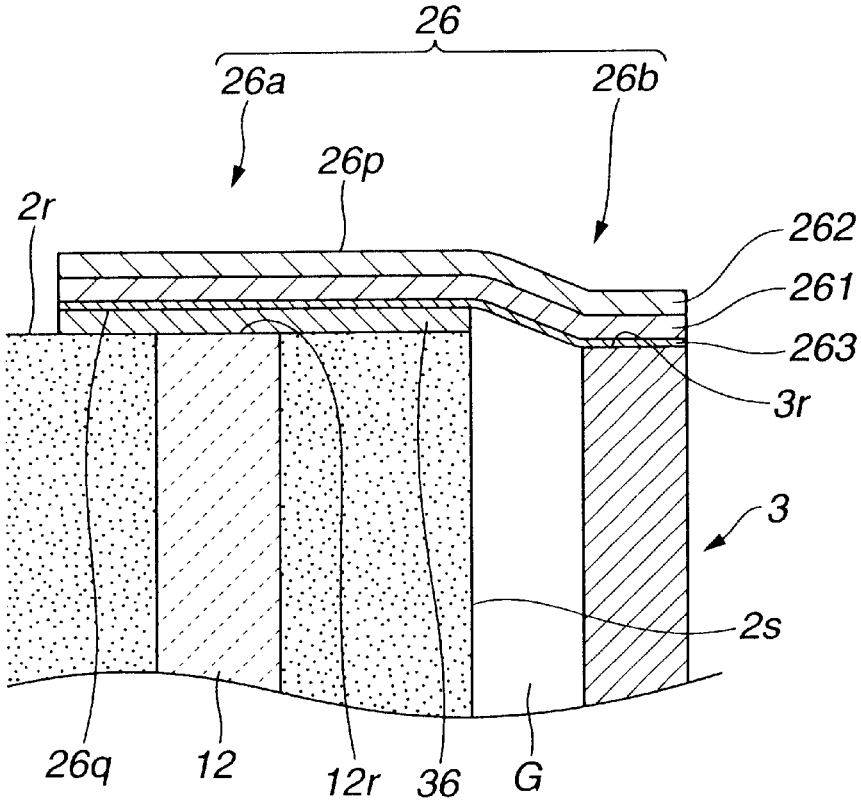
FIG. 9 is a sectional view illustrating a joint between a ceramic heater and a metallic sleeve via a first connecting member according to a third embodiment of the present invention.
Figure 10:
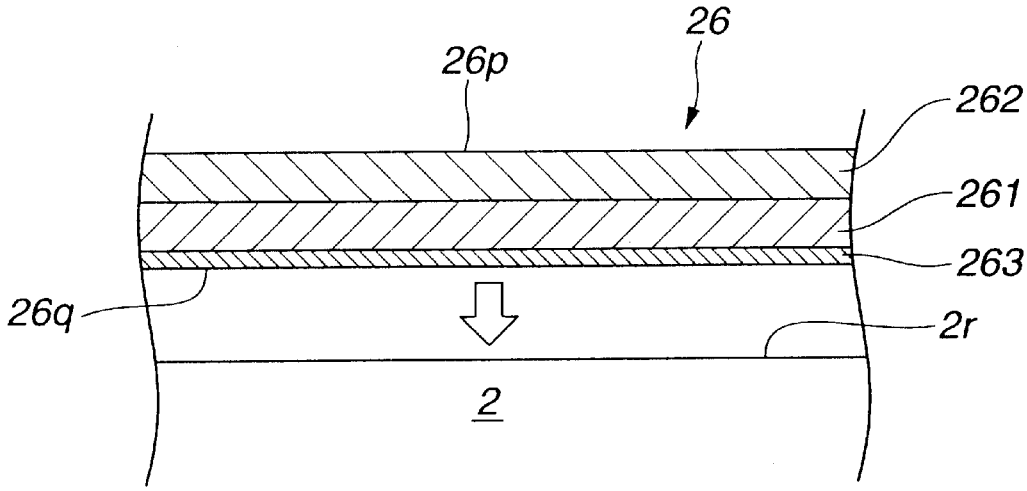
FIG. 10 is an enlarged view of the first connecting member of FIG. 9.

In the third embodiment, at least the end 26*b*' of the first connecting member 26 is formed of a clad material having a first layer 261, a second layer 262 on the rear side of the first layer 261 and a third layer 263 on the front side of the first layer 261, as shown in FIGS. 9 and 10. Materials for the second and third layers 262 and 263 have lower coefficients of linear expansion than a material for the first layer 261.

It is possible in such a three-layered clad structure of the third embodiment to absorb a thermal stress resulting from the difference in coefficients of linear expansion between the ceramic heater 2 and the brazing layers 35 and 36 as well as possible to increase joint strengths between the first connecting member 26 and the ceramic heater 2 and between the first connecting member 26 and the metallic sleeve 3, as in the first and second embodiments.

In addition, the above three-layered clad structure attains a higher degree of flexibility in increasing joint strengths between the first connecting member 26 and the ceramic heater 2 and between the first connecting member 26 and the metallic sleeve 3 by controlling the thickness and material of each layer. More specifically, the metals of the soft metal layer 61 and the low-expansion metal layer 62 of the first embodiment can be used as the materials for the first and second layers 261 and 262, respectively. In this case, the thickness of the third layer 263 is adjusted to about 20 to 100% of that of the first layer 261. When the third layer 263 has a thickness smaller than the first layer 261, the first layer 261 can preferably perform its function of absorbing the thermal stress exerted on the ceramic-metal joint. The thickness of the third layer 263 is preferably about 50 to 200 $\mu$m. For example, the first and second layers 261 and 263 are the same in thickness, and the third layer 263 is smaller in thickness than the first and second layers 261 and 262, as shown in FIG. 10. The third layer 263 may be made of the same material as the second layer 262, such as Kovar, so that the first connecting member 26 can be joined to the metallic sleeve 3 more assuredly. Further, it is desirable that the material for the third layer 263 does not cause segregation of the metal component of the brazing layer 36, exhibits wettability to the brazing material for the brazing layer 36, and is similar in composition to the material for the metallic sleeve 3 and easily weldable to the metallic sleeve 3.

Although the third layer 263 is provided throughout the first connecting member 26 in FIG. 9, the third layer 263 may be removed from the first conductive portion 26*a* by e.g. etching so that the first layer 261 gets exposed and brazed to the rear end surface 2*r* of the ceramic heater 2. This makes it possible to increase not only a joint strength between the first connecting member 26 and the metallic sleeve 3 but also a joint strength between the first connecting member 26 and the ceramic heater 2.

Finally, glow plugs according to fourth and sixth embodiments of the present invention will be described with reference to FIGS. 11 to 13. The fourth to sixth embodiments are similar to the first to third embodiments, except that the lead wire 17 and the second connecting member 27 are two separate pieces and joined to each other by e.g. welding.

Figure 11:
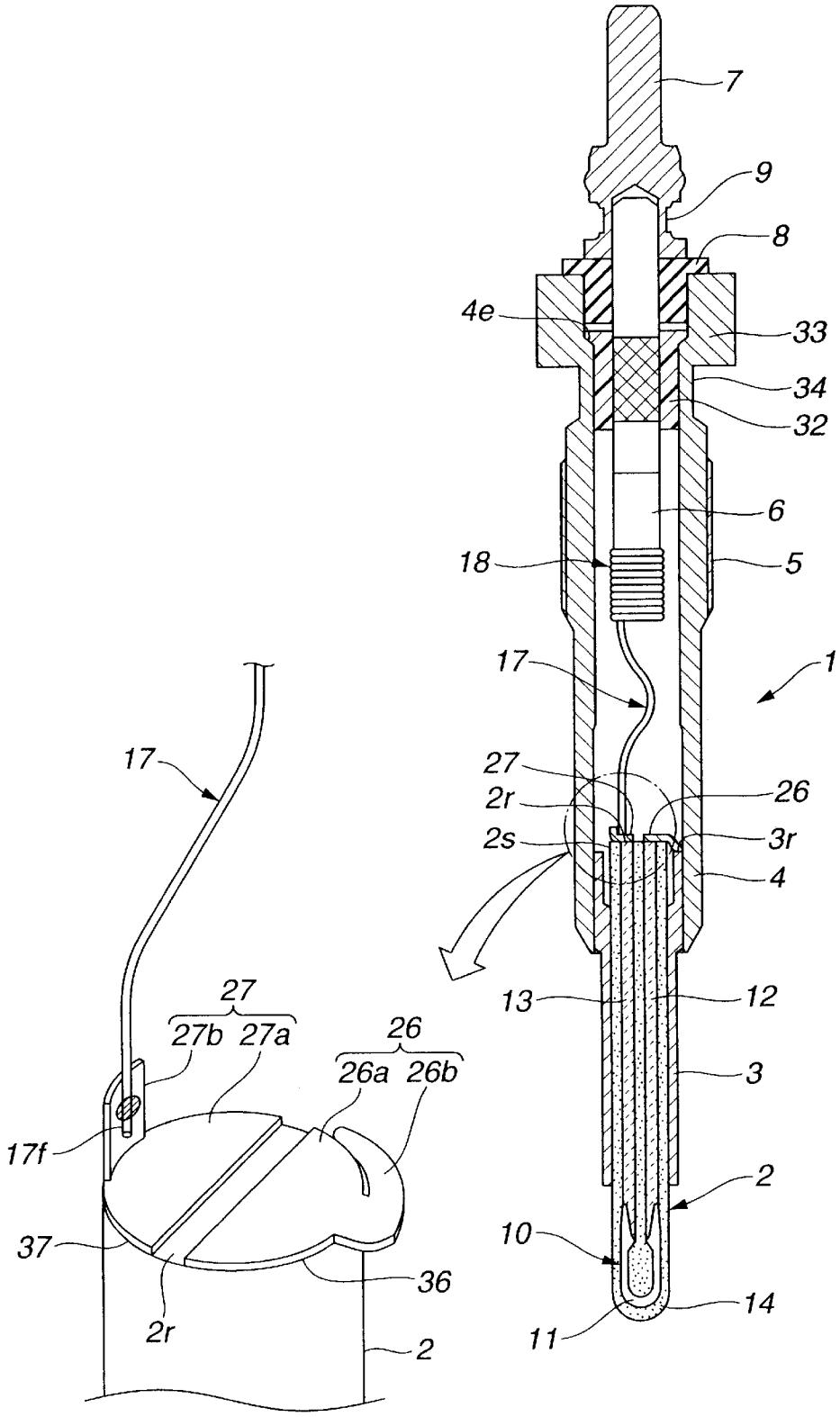
FIG. 11 is an illustration showing a joint between a lead wire and a second connecting member according to a fourth embodiment of the present invention.

In the fourth embodiment, the second connecting member 27 is provided with a first conductive portion 27*a* joined to the rear end surface 2*r* of the ceramic heater 2 by brazing and a second conductive portion 27*b* to which a front end portion 17*f* of the lead wire 17 is welded as shown in FIG. 11. The second conductive portion 27*b* may be formed integrally with the first conductive portion 27*a* so as to protrude axially toward the rear. By welding the lead wire 17 to the second conductive portion 27*b*, a joint surface between the lead wire 17 and the second connecting member 27 can be easily increased. Preferably, the weld surface of the second conductive portion 27*b* to which the lead wire 17 is welded and the front surface of the second conductive portion 26*b* welded to the metallic sleeve 3 is made of the same material suitable for welding (such as Kovar). More specifically, the low-expansion metal layers 62 (or the joint layers 63) are preferably formed in the weld surface of the second conductive portion 27*b* and in the front surface of the second conductive portion 26*b*.

Figure 12:
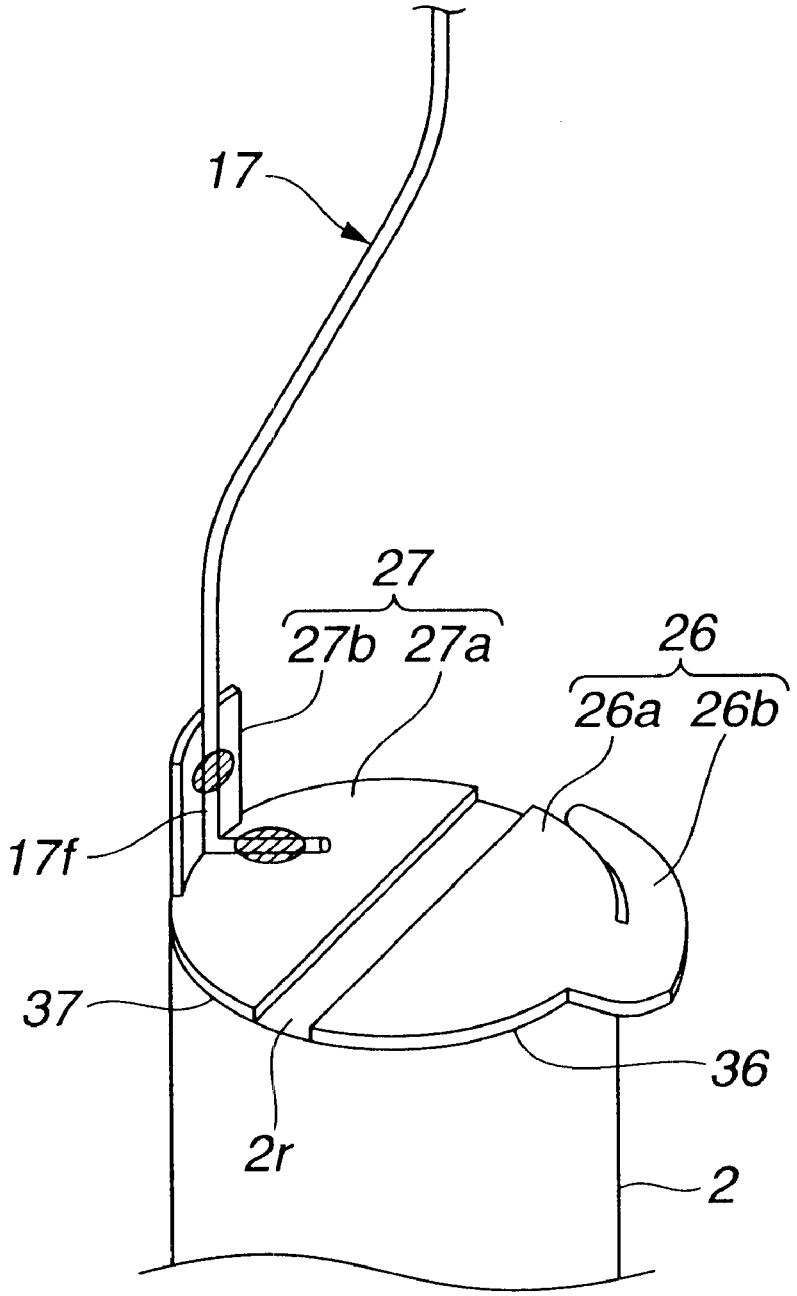
FIG. 12 is an illustration showing a joint between a lead wire and a second connecting member according to a fifth embodiment of the present invention.
Figure 13:
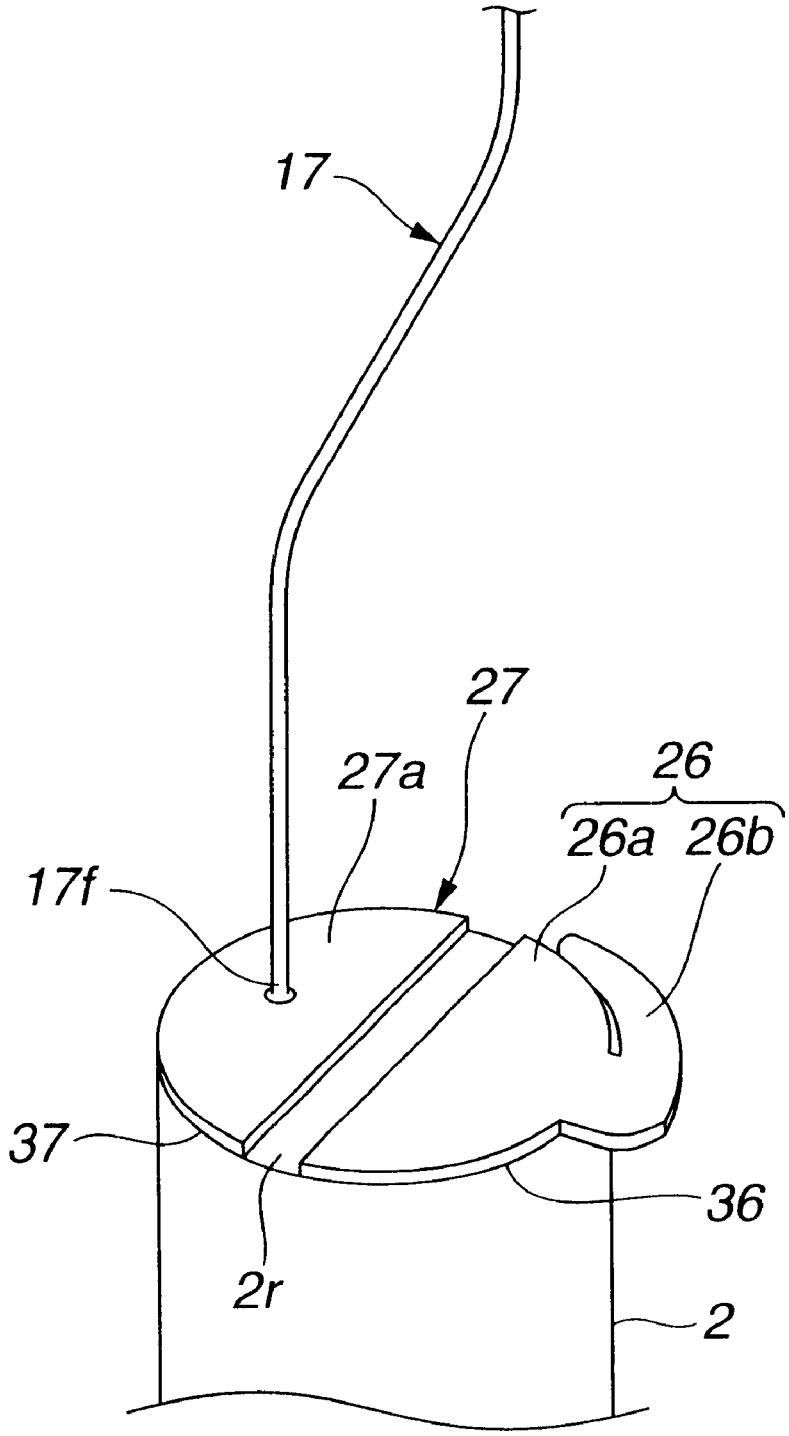
FIG. 13 is an illustration showing a joint between a lead wire and a second connecting member according to a sixth embodiment of the present invention.

In the fifth embodiment, the second connecting member 27 has the first conductive portion 27*a* and the second conductive portion 27*b*, and the lead wire 17 is bent so as to fit with the first and second conductive portions 27*a* and 27*b*, as shown in FIG. 12, so that the front end portion 17*f* of the lead wire 17 is welded to both the first and second conductive portion 27*a* and 27*b*. By this, a joint strength between the lead wire 17 and the second connecting member 27 can be further increased.

In the sixth embodiment, the second connecting member 27 has the conductive portion 27*a* joined by brazing to the rear end surface 2*r* of the ceramic heater 2, and the front end portion 17*f* of the lead wire 17 is welded to the conductive portion 27*a*. The front end portion 17*f* of the lead wire 17 is not bent in this case. Preferably, the front end portion 17*f* of the lead wire 17 is welded to the center of the conductive portion 27*a* of the second connecting member 27, as shown in FIG. 13, such that the second connecting member 27 can be prevented from separating from the rear end surface 2*r* of the ceramic heater 2.

The lead wire 17 may have a coiled portion 18 at a rear end thereof so that the front end portion of the central electrode 6 is disposed in and welded to the coiled portion 18, as shown in FIG. 11. In such a case, the front end portion of the central electrode 6 may be brazed to the coiled portion 18 with an activated brazing material. When the front end portion of the central electrode 6 is joined to the rear end of the coiled portion 18, the lead wire 17 can easily accommodate changes in distance between the central electrode 6 and the conductive portion 27*b* of the second connecting member 27. The lead wire 17 is preferably made of an annealed material, which is relatively soft.

As described above, the rear end portion 12*r* of the electric conductor 12 is exposed at the rear end surface 2*r* of the ceramic heater 2 and electrically connected to the rear end face 3*r* of the metallic sleeve 3 via the first connecting member 26. It is therefore possible to attain larger joint surfaces between the electric conductor 12 and the first connecting member 26 and between the metallic sleeve 3 and the first connecting member 26 to increase joint strengths therebetween, while eliminating the possibility of faulty electrical continuity. As a result, such joints are less prone to deterioration even when heated and cooled in cycles through the use of the glow plug 1. The production of the glow plug 1 can be also made easier, because there is no need to expose the electric conductor 12 at the outer circumferential surface 2*s* of the ceramic heater 2.

Although the invention has been described with reference to the specific embodiments thereof, the invention is not limited to the above-described embodiments. Various modification and variation of the embodiments described above will occur to those skilled in the art in light of the above teaching. The scope of the invention is defined with reference to the following claims.

What is claimed is:

1. A glow plug comprising:

a ceramic heater having an insulating ceramic substrate, a heating resistor embedded in a front end portion of the ceramic substrate, and a pair of first and second electric conductors embedded in the ceramic substrate and electrically connected at front end portions thereof to the heating resistor; and a metallic sleeve circumferentially surrounding the ceramic heater with a front end portion of the ceramic heater protruded from the metallic sleeve, the first electric conductor having a rear end portion exposed at a rear end surface of the ceramic heater and electrically connected to the metallic sleeve.

2. A glow plug according to claim 1, wherein the ceramic heater is disposed in the metallic sleeve with a rear end portion of the ceramic heater protruded from the metallic sleeve.

3. A glow plug according to claim 1, further comprising a first connecting member through which the exposed rear end portion of the first electric conductor is electrically connected to a rear end face of the metallic sleeve.

4. A glow plug according to claim 3, wherein the first connecting member has a first conductive portion joined to the rear end surface of the ceramic heater and a second conductive portion formed integrally with the first conductive portion so as to extend to the metallic sleeve and joined at a end thereof to the rear end face of the metallic sleeve, and the end of the second conductive portion is shaped to fit with the rear end face of the metallic sleeve.

5. A glow plug according to claim 3, wherein the first connecting member is joined to the rear end surface of the ceramic heater via a brazing layer made of an activated brazing material.

6. A glow plug according to claim 5, wherein the first connecting member is formed into a plate and has a low-expansion metal layer formed in a rear surface thereof so as to correspond in position to the brazing layer while being in contact with the brazing layer at a front surface thereof, and the low-expansion metal layer is made of a metal having a lower coefficient of linear expansion than the activated brazing material.

7. A glow plug according to claim 6, wherein the first connecting member further has a soft metal layer formed in the front surface thereof so as to be in contact with the brazing layer, and the soft metal layer is made of a metal softer than the metal of the low-expansion metal layer.

8. A glow plug according to claim 7, wherein the low-expansion metal layer and the soft metal layer are clad with each other at least in part of the first connecting member.

9. A glow plug according to claim 5, wherein the first connecting member includes an end portion joined to the rear end face of the metallic sleeve, and the end portion of the first connecting member is made of a metal having a lower coefficient of linear expansion than the activated brazing material.

10. A glow plug according to claim 3, wherein the first connecting member is formed into a plate and has first and second layers formed in a thickness direction thereof, the first connecting member is bent so that the first layer is joined to the rear end surface of the ceramic heater via the brazing layer and the second layer is joined to the rear end face of the metallic sleeve, and the first layer is made of a material having a higher coefficient of linear expansion than a material for the second layer.

11. A glow plug according to claim 3, wherein the first connecting member includes an end portion joined to the rear end face of the metallic sleeve, the end portion of the first connecting member has a first layer, a second layer on a rear side of the first layer and a third layer on a front side of the first layer, and the first layer is made of a material having a higher coefficient of linear expansion than materials for the second and third layers.

12. A glow plug according to claim 1, the ceramic heater is disposed in the metallic sleeve with a clearance between an outer circumferential surface of the ceramic heater and an inner circumferential surface of a rear end portion of the metallic sleeve.

13. A glow plug according to claim 12, wherein the clearance is larger than or equal to 0.1 mm.

14. A glow plug comprising:

a ceramic heater having an insulating ceramic substrate, a heating resistor embedded in a front end portion of the ceramic substrate, and a pair of first and second electric conductors embedded in the ceramic substrate and electrically connected at front end portions thereof to the heating resistor;

a metallic sleeve circumferentially surrounding the ceramic heater with a front end portion of the ceramic heater protruded from the metallic sleeve;

a metallic shell fitted onto the metallic sleeve; and a central electrode disposed in a rear portion of the metallic shell, the first and second electric conductors having rear end portions exposed at a rear end surface of the ceramic heater and electrically connected to the metallic sleeve and the central electrode, respectively.

15. A glow plug according to claim 14, further comprising:

a first connecting member through which the rear end portion of the first electric conductor is electrically connected to a rear end face of the metallic sleeve; and a second connecting member through which the rear end portion of the second electric conductor is electrically connected to the central electrode.

16. A glow plug according to claim 15, wherein the first and second connecting members are formed into one piece and separated from each other after joined to the rear end surface of the ceramic heater.

17. A glow plug according to claim 15, further comprising a lead wire through which the second connecting member and the central electrode are electrically connected to each other, wherein the first connecting member includes a joint portion having a surface layer welded to the rear end face of the metallic sleeve, the second connecting member includes a joint portion having a surface layer to which the lead wire is welded, the surface layers of the joint portions of the first and second connecting members are made of the same material.

18. A glow plug according to claim 17, wherein the joint portion of the second connecting member is protruded rearwardly.

19. A glow plug according to claim 15, wherein the first and second connecting members are joined to the rear end surface of the ceramic heater via brazing layers made of an activated brazing material.

* * * * *